US006331108B1

(12) United States Patent
Stiner

(10) Patent No.: US 6,331,108 B1
(45) Date of Patent: Dec. 18, 2001

(54) CONVERTIBLE GAS-BURNING APPLIANCE

(75) Inventor: Roy E. Stiner, Owasso, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/419,581

(22) Filed: Oct. 18, 1999

(51) Int. Cl.[7] ..... F21L 9/00

(52) U.S. Cl. ..... 431/344; 431/156; 431/100; 362/179; 126/38; 126/40

(58) Field of Search ..... 431/125, 156, 431/142, 143, 344, 100; 126/40, 38; 222/399, 402.15, 182, 183, 474, 5, 473; 362/179; 251/149.4

(56) References Cited

U.S. PATENT DOCUMENTS

| | | | |
|---|---|---|---|
| 2,436,995 | * | 3/1948 | Hamilton . |
| 2,749,733 | * | 6/1956 | Smith et al. . |
| 3,140,740 | | 7/1964 | Lagreid et al. . |
| 3,294,079 | | 12/1966 | Thompson . |
| 3,361,298 | * | 1/1968 | Trumble . |
| 3,574,505 | | 4/1971 | Kimball . |
| 3,626,476 | * | 12/1971 | Trumble . |
| 3,877,458 | | 4/1975 | Allander . |
| 3,900,281 | | 8/1975 | Penberthy . |
| 3,907,490 | * | 9/1975 | Schaller . |
| 3,933,146 | | 1/1976 | Hastings . |
| 4,043,744 | * | 8/1977 | Svensson . |
| 4,092,974 | | 6/1978 | Zenzaburo . |
| 4,098,436 | * | 7/1978 | Kohlbeck . |
| 4,545,759 | | 10/1985 | Giles et al. . |
| 4,954,075 | | 9/1990 | Francino . |
| 5,101,998 | * | 4/1992 | Hwang . |
| 5,803,727 | | 9/1998 | Long . |
| 5,860,410 | | 1/1999 | Hollingsworth, Jr. . |
| 5,890,887 | | 4/1999 | Adler . |

* cited by examiner

*Primary Examiner*—Carl D. Price
(74) *Attorney, Agent, or Firm*—Fellers, Snider, Blankenship, Bailey & Tippens

(57) ABSTRACT

An apparatus adaptable for holding, and burning gas fuels from, different containers, the different containers including at least a first container and a second container. The apparatus preferably comprises: a housing sized such that each of the different containers is removably receivable in the housing; a burner assembly for receiving and burning gas fuel from each of the different containers; a stand or other elevating structure positionable in the housing for elevating and retaining the first container in the housing in an operating position, the elevating structure being removable from the housing for placing the second container in the housing in its operating position; and an adaptor removably attachable between the second container and the burner assembly.

15 Claims, 12 Drawing Sheets

CONVERTIBLE GAS-BURNING APPLIANCE

FIELD OF THE INVENTION

This application relates to gas-burning devices which can be selectively converted from the use of intended gas fuels to other gas fuels. More particularly, but not by way of limitation, the invention relates to camp-type devices which are selectively convertible from the use of intended gas fuels to the use of alternate gas fuels supplied at substantially different pressures.

BACKGROUND OF THE INVENTION

Portable gas stoves, lanterns, and other appliances used for camping, backpacking, etc., are typically fueled by either propane or butane. Most such appliances purchased and used in the United States are designed to burn propane. However, throughout the rest of the world, most of these devices are designed to burn butane.

Portable butane appliances generally operate at much lower pressures than do portable propane devices. Typical propane supply pressures can be two, two and one-half, three, and even four times greater than typical butane supply pressures. The pressure of a butane supply container used for portable, camp-type devices will typically be in the range of from about 30 to about 60 psig. However, the pressure of a propane supply container used for portable, camp-type devices will typically be in the range of from about 125 to about 200 psig.

In addition, the discharge fittings provided on small, propane containers used for camping, backpacking, etc., are typically different from those used on butane containers. Moreover, the gas inlet fittings of butane-burning devices are typically different from those used of propane-burning devices.

It would be very beneficial to convert the U.S. camping market from propane-burning devices to butane-burning devices. Because they operate at much lower supply pressures, butane devices are safer and more economical than propane devices. Additionally, unlike propane appliances, butane devices can be used substantially worldwide. Unfortunately, however, a switch to butane devices in the United States has not been practical in view of the fact that butane canisters for camping and backpacking are not readily available. Moreover, it is not foreseeable that such compact, butane canisters will become available in the U.S. market until a substantial number of butane devices are placed in use.

Thus, a need presently exists for appliances capable of being quickly and easily converted from the use of intended gas fuels to other gas fuels. In particular, a need exists for portable, butane-burning lanterns, stoves, and other appliances for camping, backpacking, etc., which can be quickly and easily adapted to receive and burn propane supplied from the camp-type propane containers presently available in the U.S. These appliances will preferably be compact and will most preferably be adapted such that all of the components thereof can be easily and securely stored and carried together. Appliances of this type sold in the U.S. could be powered by propane until appropriate butane supplies are readily available. Such appliances could also be used in any region of the world, regardless of whether propane or butane is the predominate fuel of choice.

SUMMARY OF THE INVENTION

The present invention provides convertible, gas-burning appliances which address the needs and alleviate the problems discussed above. By way of example, but not by way of limitation, the inventive appliance can be a compact lantern, stove, or other appliance of a type used for camping or backpacking. The inventive appliance allows different fuels (e.g., propane and butane) and different types of fuel supply containers to be used interchangeably, regardless of whether such fuels and fuel containers have significantly different dimensions and/or supply pressures. When the gas supply container is removed from the inventive appliance, the appliance is collapsible for storage such that all of the components of the appliance are conveniently and securely held within the appliance housing.

In one aspect, the present invention provides an apparatus adaptable for holding, and burning gas fuels from, different containers, the different containers including at least a first container and a second container. The apparatus comprises: a housing sized such that each of the different containers is removably receivable in the housing; burning means for burning gas fuel from the containers; and elevating means, positionable in the housing, for elevating the first container. Each of the different containers has an operating position in the housing. The operating position of the first container is different from the operating position of the second container. The elevating means is operable for retaining the first container in the housing in its operating position. However, the elevating means is removable from the housing for placing the second container in the housing in its operating position.

In another aspect, the present invention provides an apparatus adaptable for holding, and burning gas fuel from, a container. The apparatus comprises: a housing sized such that the container is removably receivable in the housing in an operating position; burning means for burning the gas fuel; an adaptor removably attachable between the container and the burner means; and a limiting means for limiting flow of gas fuel from the container to the burner means through the adaptor.

Further objects, features, and advantages of the present invention will be apparent upon examining the accompanying drawings and upon reading the following description of the preferred embodiments.

DETAILED DESCRIPTION OF THE PREFERRED EMBODIMENTS

Figure 1:
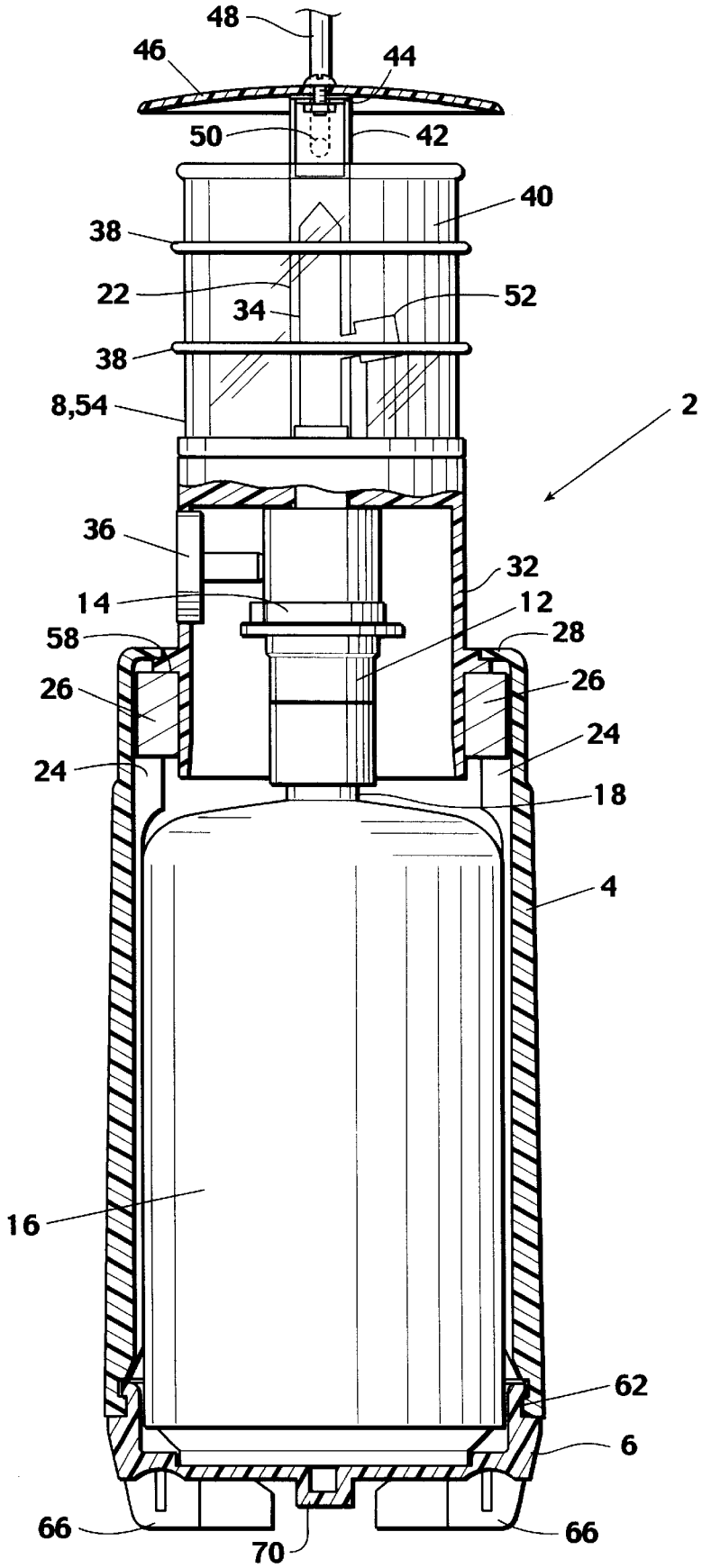
FIG. 1 is a cutaway elevational side view of an embodiment 2 of the inventive appliance having a propane canister 16 installed therein.
Figure 2:
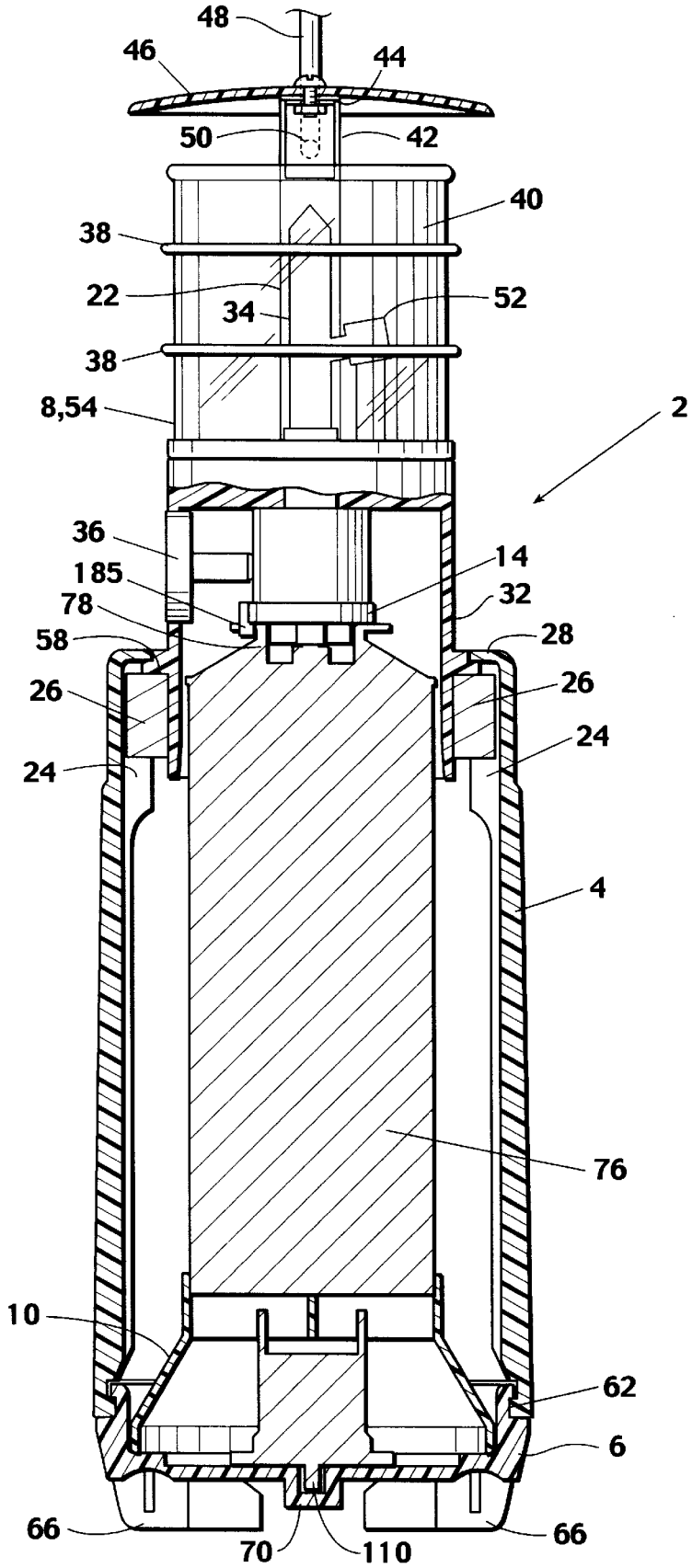
FIG. 2 is a cutaway elevational side view of inventive appliance 2 having a butane canister 76 installed therein.
Figure 3:
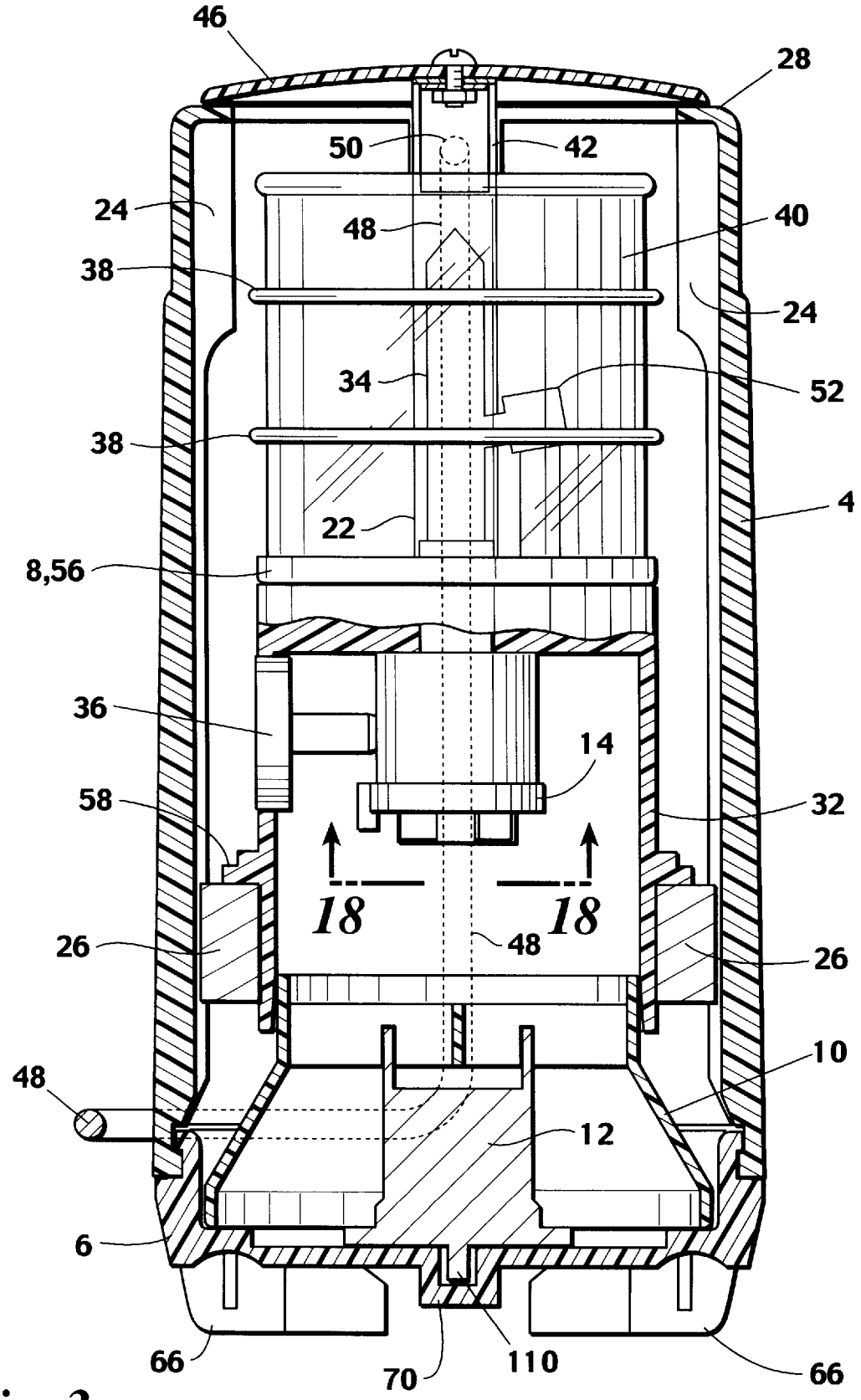
FIG. 3 is a cutaway elevational side view of inventive appliance 2 in a storage position.

An embodiment 2 of the inventive appliance is depicted in FIGS. 1–3. Embodiment 2 is a collapsible, camp-type, gas lantern. Inventive appliance 2 comprises: a somewhat cylindrical housing 4; a base 6 removably attachable to the lower end of housing 4; a retractable burner assembly 8 which can be pulled out of the top of housing 4 to an operating position 54 as depicted in FIGS. 1 and 2; an elevating stand 10 removably positionable in housing 4 on base 6; and an adaptor 12 removably connectable to a gas inlet fitting 14 provided at the bottom of burner assembly 8. As discussed hereinbelow, adaptor 12 allows inventive appliance 2 to interchangeably use: (a) gas fuels having substantially different supply pressures, (b) gas supply canisters having significantly different lengths, diameters, and/or other dimensions; and/or (c) gas supply canisters having significantly different types of discharge fittings.

Housing 4 is sized and configured such that it will receive each of the various types of fuel canisters which might be used in inventive appliance 2. Housing 4 is also sized such that, when adaptor 12 must be used to link the fuel canister with burner inlet fitting 14, both the fuel canister and adaptor 12 can be positioned and held in housing 4.

Burner assembly 8 can be generally any type of burner assembly commonly used in the art. The burner assembly 8 shown in inventive appliance 2 is a common, butane-burning lantern assembly comprising: a housing 32; a butane inlet fitting 14 provided within the bottom of housing 32; a burner element 34 projecting from the top of housing 32; a flow conduit and gas valve (not shown) within housing 32 linking inlet fitting 14 with burner element 34; a valve dial 36, positioned in the side wall of housing 32, for adjusting the amount of gas flow to burner element 34; a wire cage 38 and a glass globe 40 removably positionable on top of housing 32 around burner element 34; an opposing pair of elongate, vertical side bars 22 extending upwardly from housing 32 such that the upper ends 42 thereof are preferably positioned above wire cage 38 and globe 40; an upper cross piece 44, connectable between the upper ends 42 of side bars 22, for attaching a top cover 46; and a handle 48 having ends 50 which are pivotably positionable through apertures provided in cross piece 44 and in the upper ends of side bars 22. As will be understood by those skilled in the art, burner assembly 8 can also include other common features such as a spark igniter 52.

In FIG. 1, inventive appliance 2 is depicted with butane burner assembly 8 in operating position 54 and a propane canister 16 of the type commonly used for camping and backpacking positioned within housing 4. Because the discharge fitting 18 employed on propane canister 16 will typically be of a type which will not mate directly with a butane burner fitting 14, adaptor 12 must be used to link propane canister 16 with burner assembly 8. Housing 4 is therefore sized such that both propane canister 16 and adaptor 12 will fit within housing 4. Additionally, as explained hereinbelow, adaptor 12 will, for this particular application, preferably include means for significantly limiting the flow and reducing the pressure of the propane gas flowing from propane canister 16 such that the propane can be burned in the butane burner assembly 8.

As shown in FIGS. 1 and 2, burner assembly 8 can be pulled through the top of appliance housing 4 to operating position 54. However, when there is no fuel container positioned in housing 4, burner assembly 8 can, as depicted in FIG. 3, be retracted into the top of housing 4 to a storage position 56. To permit such reciprocating/retractable movement of burner assembly 8, housing 4 preferably includes: an opposing pair of interior, vertical side channels 20 sized for slidably receiving the vertical side bars 22 provided on burner assembly 8; a second pair of opposing, vertical, interior side channels 24 for slidably receiving guides 26 provided on burner assembly 8; an inwardly extending lip 28 provided at the upper end of housing 4; and a pair of openings 30 provided through lip 28 at the upper ends of side channels 20. Openings 30 allow the side bars 22 of burner assembly 8 to slide out of, and into, the top housing 4. Side bars 22 and guides 26 guide the vertical movement and prevent rotation of burner assembly 8. In addition, burner assembly 8 includes a shoulder 58 provided around the exterior of burner housing 32 such that, as burner assembly 8 approaches its fully extended operating position 54, shoulder 58 will contact the upper lip 28 of appliance housing 4 and thus prevent burner assembly 8 from being further removed from the top of housing 4.

Figure 4:
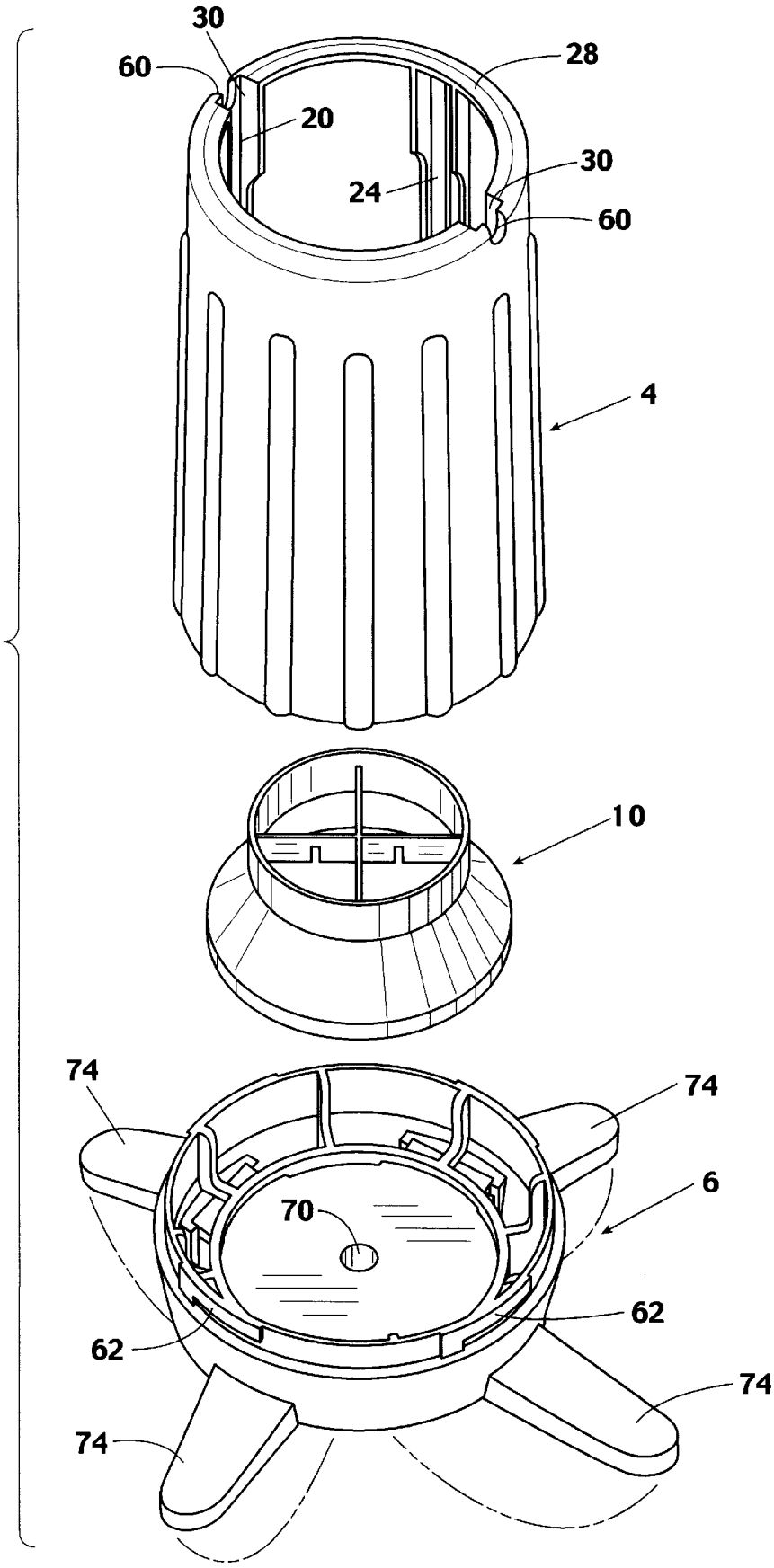
FIG. 4 is an exploded view of the housing 4, stand 10, and base 6 of the inventive appliance 2.
Figure 5:
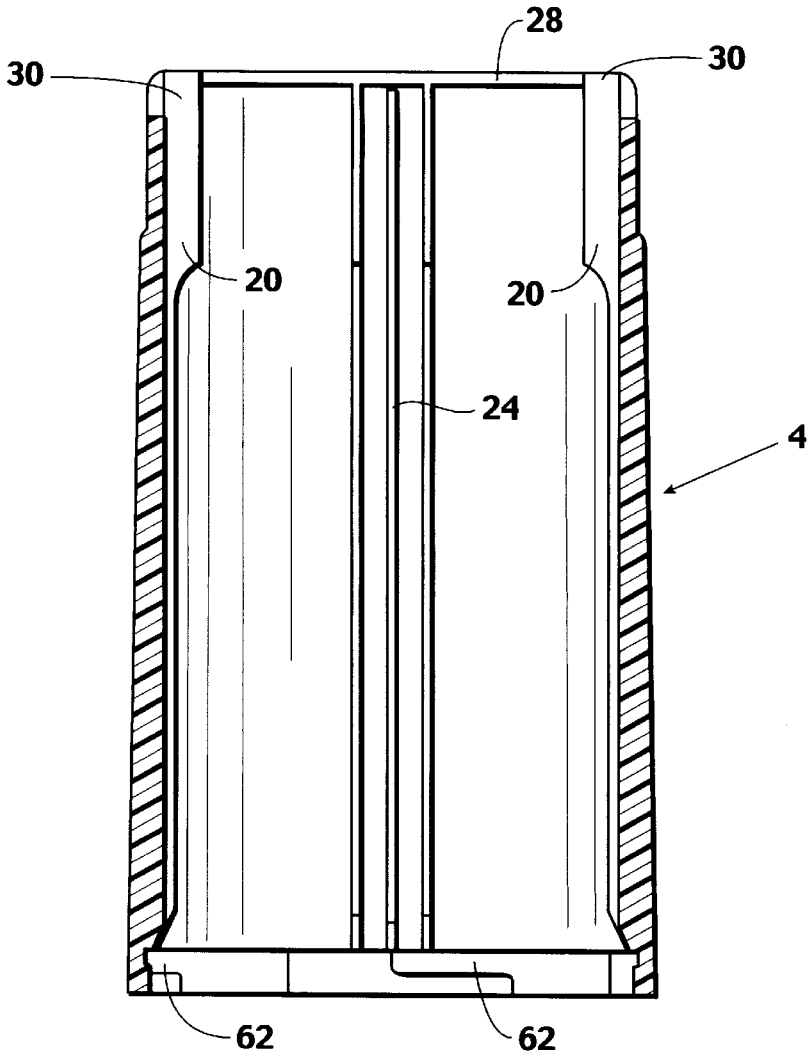
FIG. 5 is a cutaway elevational side view of housing 4.
Figure 6:
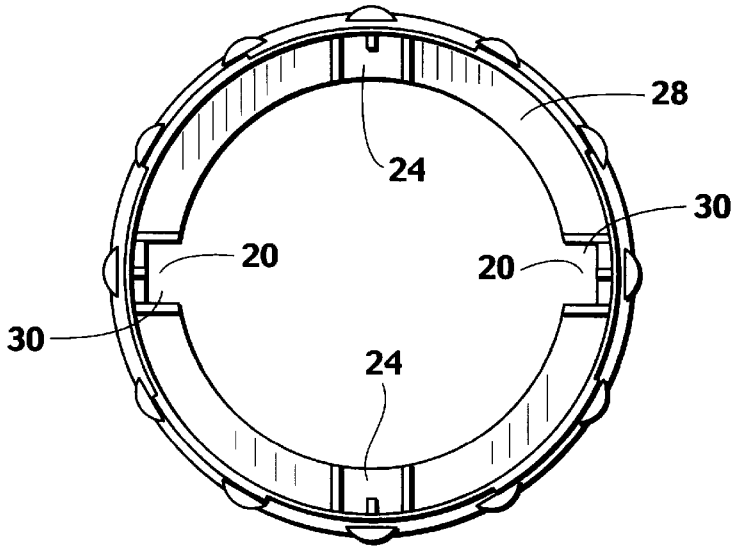
FIG. 6 is a bottom view of housing 4.
Figure 7:
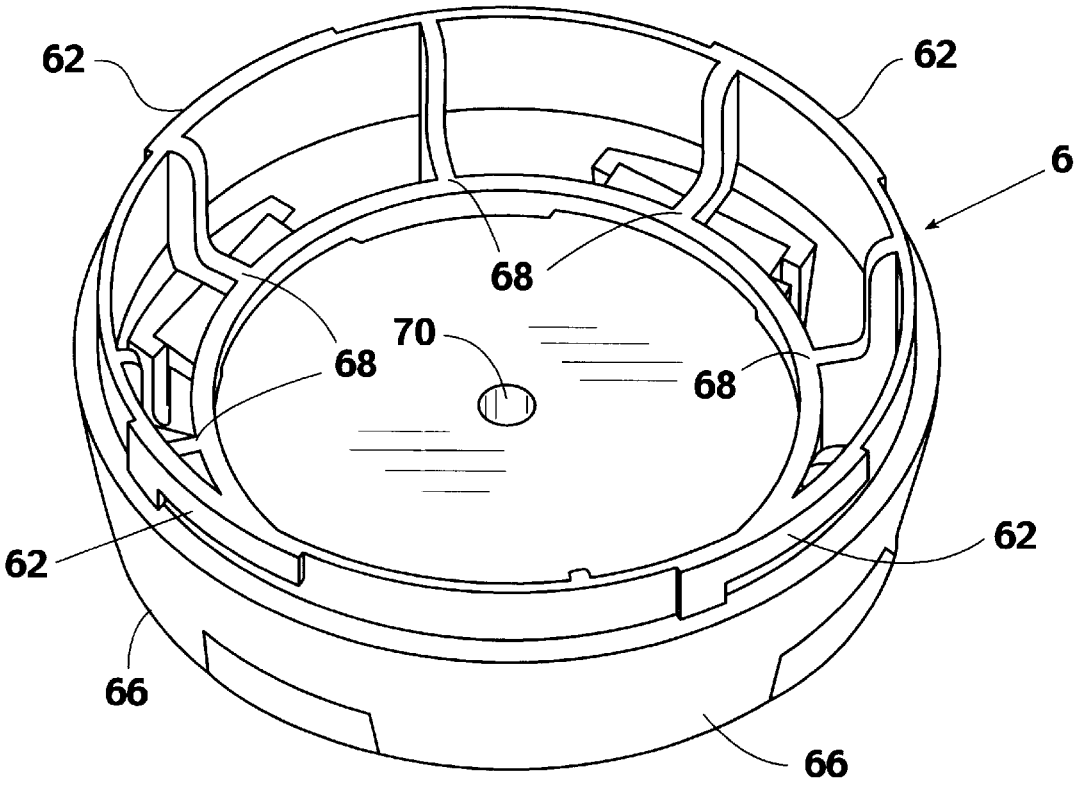
FIG. 7 is a top, perspective view of base 6.
Figure 8:
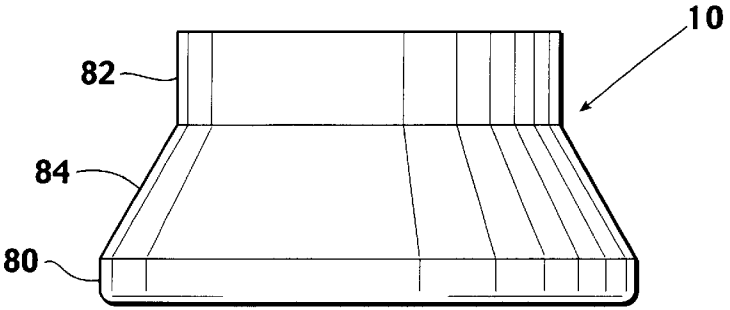
FIG. 8 is an elevational side view of stand 10.
Figure 11:
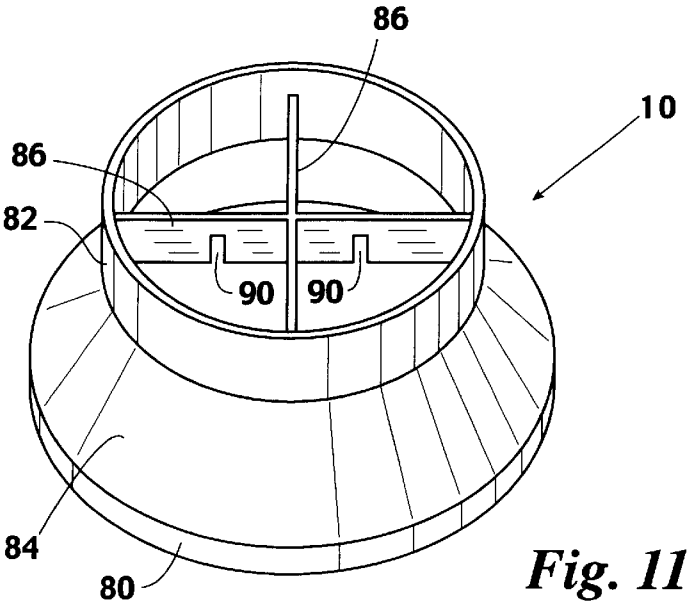
FIG. 11 is a top, perspective view of stand 10.
Figure 9:
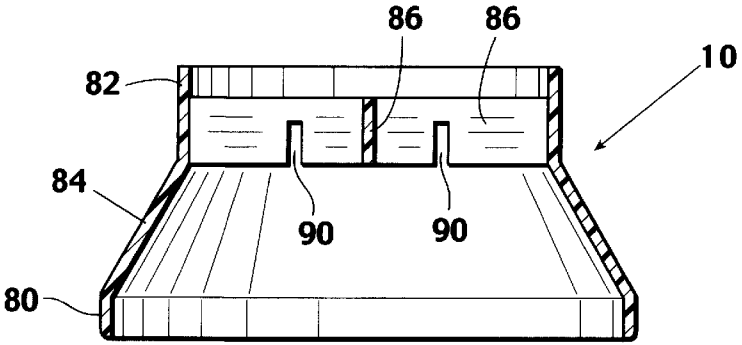
FIG. 9 is a cutaway elevational side view of stand 10.
Figure 10:
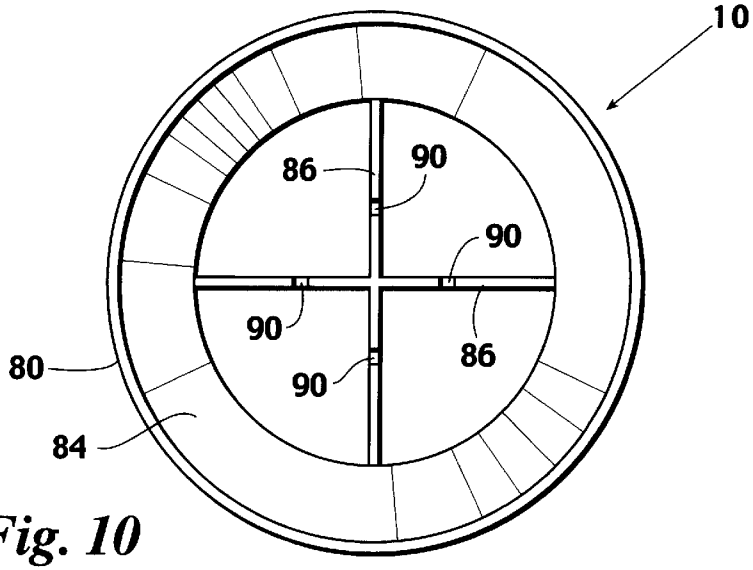
FIG. 10 is a bottom view of stand 10.
Figure 12:
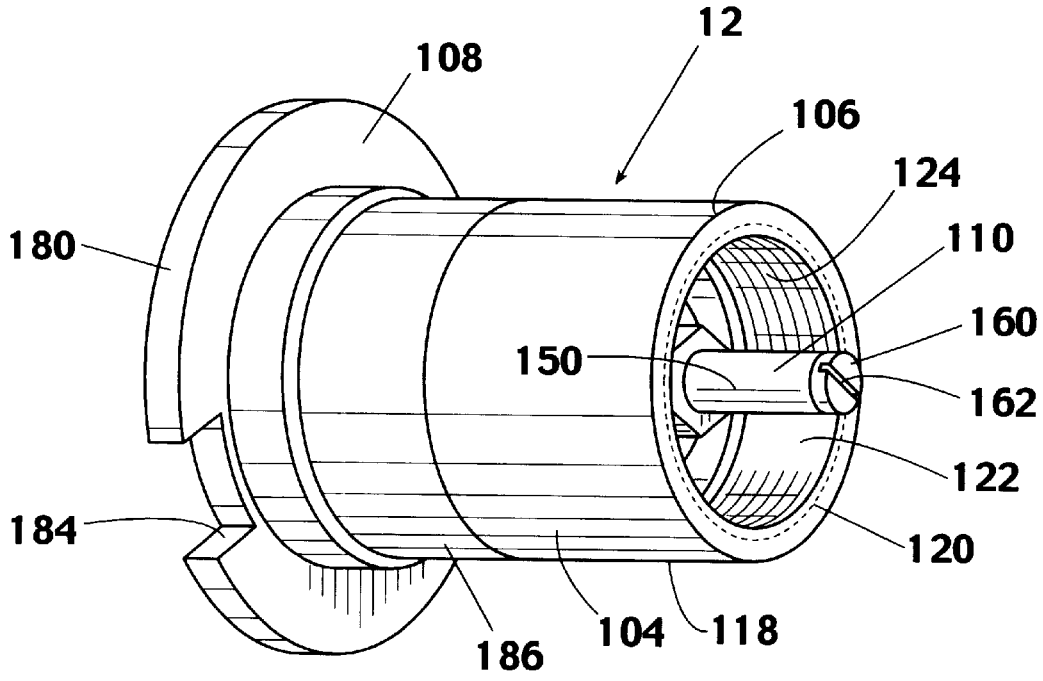
FIG. 12 is a rear, perspective view of an inventive adaptor 12 employed in inventive appliance 2.
Figure 13:
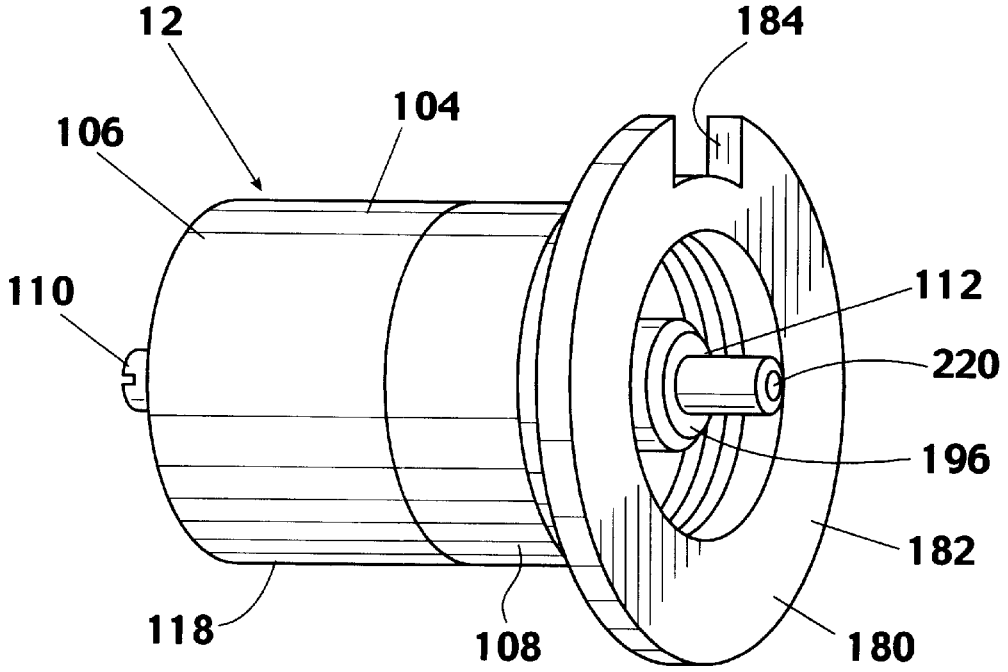
FIG. 13 is a front, perspective view of adaptor 12.
Figure 14:
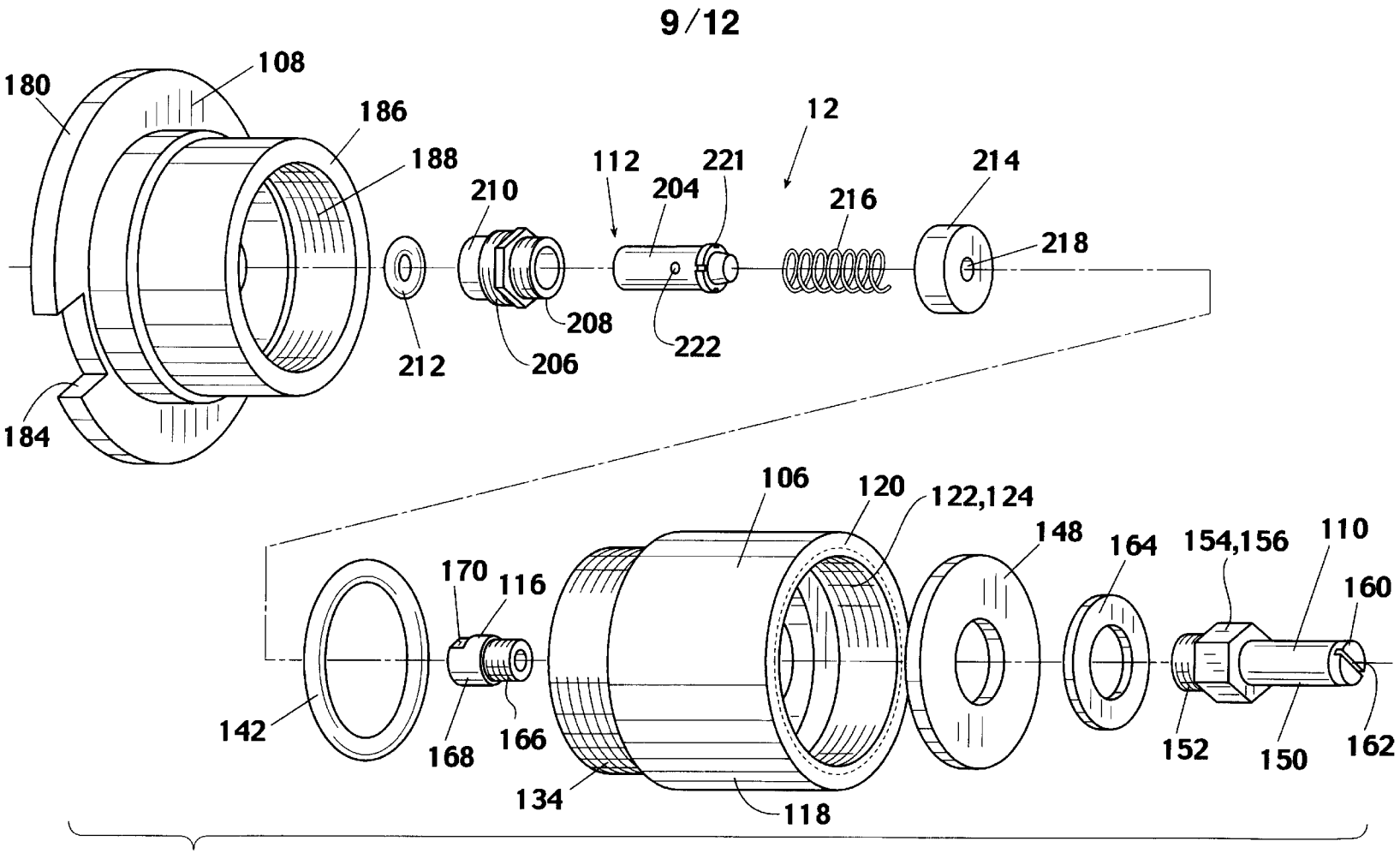
FIG. 14 is an exploded view of adaptor 12.
Figure 15:
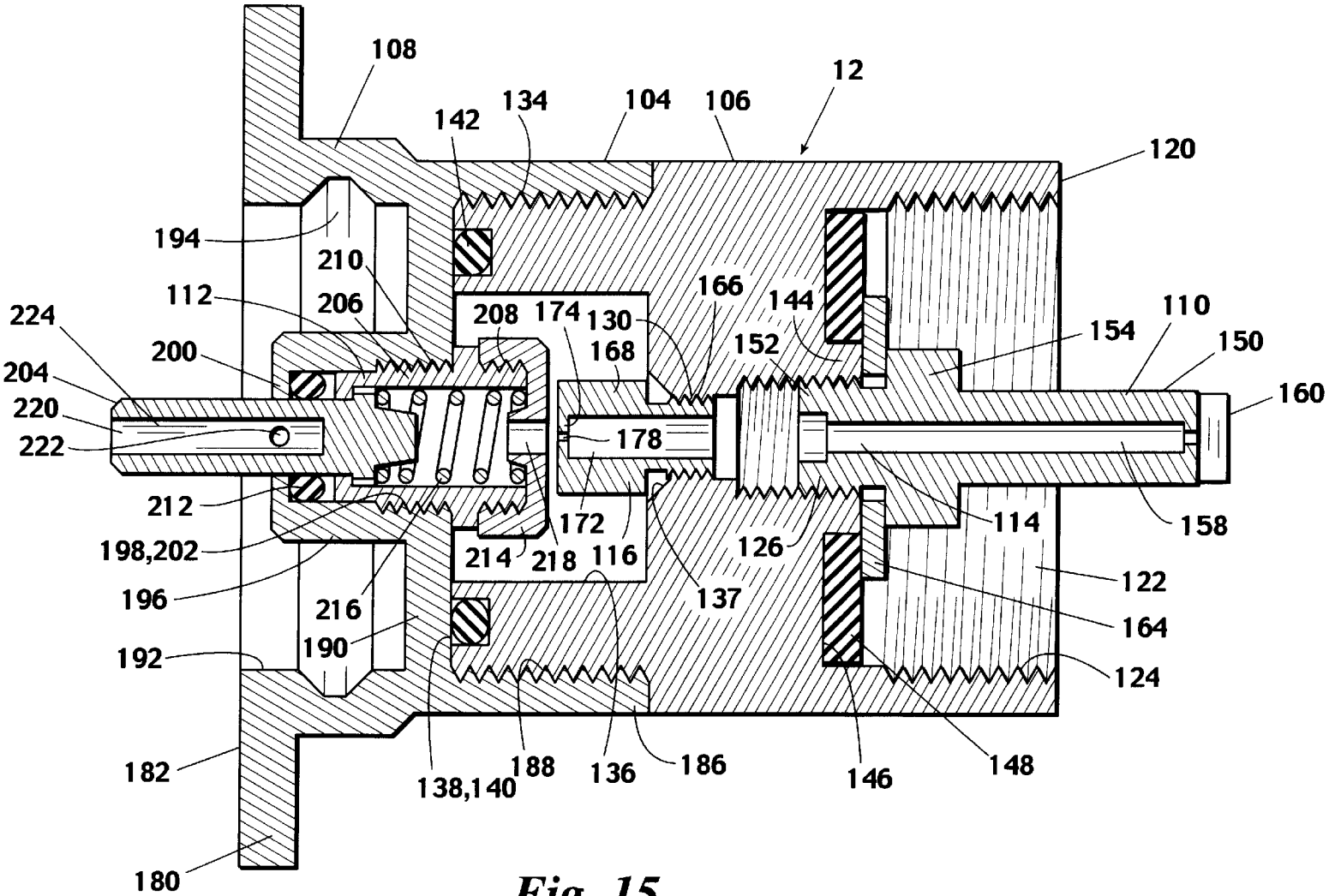
FIG. 15 is a cutaway elevational side view of adaptor 12 with the valve assembly 112 thereof in closed position.

As depicted in FIG. 4, appliance housing 4 preferably also includes rounded openings 60 extending downwardly into the sidewall of housing 4 from lip openings 30. Rounded openings 60 are sized and positioned for receiving the ends 50 of handle 48 when burner assembly 8 is retracted into appliance housing 4. Rounded openings 60 allow handle 48 to be pivoted freely upwardly for carrying inventive appliance 2 when burner assembly 8 is in its storage position 56.

Base 6 is removably attachable to the bottom of housing 4 for (a) retaining fuel canisters within housing 4 when appliance 2 is in use and (b) securely retaining and storing burner assembly 8, stand 10, and adaptor 12 in appliance housing 4 when appliance 2 is not in use. Base 6 preferably comprises: bayonet-type attachment structures 62, threads, or other attachment structures which releasably mate with corresponding structures 62 provided on the bottom end portion of appliance housing 4; legs, bosses, or other exterior structures 66 provided on the bottom of base 6 for supporting appliance 2 on a surface; an interior bottom surface, interior ridges 68, or other interior support structures upon which fuel canisters and/or stand 10 will be supported and held within appliance housing 4; and a cup 70 or other enclosed structure extending downwardly from the center of base 6 for receiving the probe 110 of adaptor 12 when adaptor 12 is retained and stored in appliance housing 4.

Base 6 can also include legs 74 on the bottom thereof which can be pivoted outwardly to effectively widen the base to assist in preventing the inventive appliance from being tipped over. The greater stability provided by pivoting legs 74 could be particularly desirable, for example, when inventive appliance 2 is a stove.

As will be apparent to those skilled in the art, other or additional structures could be added to base 6 in order to provide a wider footprint, allow the appliance to be held in an additional, more stable base structure, or otherwise increase the stability of the inventive appliance.

FIGS. 1 and 2 depict two significantly different types of fuel canisters retained in different operating positions in appliance housing 4. As discussed above, canister 16 is a commonly used propane canister having a propane discharge fitting 18. Canister 76, on the other hand, is a common butane canister having a butane discharge fitting 78. The butane discharge fitting 78 of canister 76 can be directly coupled with the butane inlet fitting 14 provided at the bottom of burner assembly 8. However, the propane discharge fitting 18 provided on propane canister 16 cannot. Thus, sufficient vertical space must be included in appliance housing 4 for linking the propane discharge fitting 18 of propane canister 16 to burner inlet fitting 14. However, because of this additional vertical space, butane canister 76, which does not require the use of adaptor 12, must be held in an elevated position within housing 4.

In embodiment 2 of the inventive apparatus, butane canister 76 is held in its elevated operating position by stand 10. However, as will be apparent to those skilled in the art, numerous other types of structures could be used for holding butane canister 76 in an elevated position within housing 4. Stand 10 and adaptor 12 are sized according to the actual vertical heights of canisters 16 and 76 such that canisters 16 and 76 can be used interchangeably within inventive appliance 2.

As depicted in FIGS. 1 and 2, the diameter of butane canister 76 will typically be considerably less than that of propane canister 16. Thus, base 6 is sized for directly retaining the bottom end of the larger diameter propane canister 16. The bottom of canister 16 rests upon, and is directly supported by, the interior support structures 68 provided in base 6.

In order to support the smaller diameter butane canister 76 within appliance housing 4, stand 10 comprises: a wide base 80 which will directly rest upon the interior support structures 68 of base 6; a cup 82 provided at the upper end of stand 10 and sized for receiving the bottom of butane canister 76; a frusto-conical swedge segment 84 which supports cup 82 above base 80; and a pair of perpendicular, interior cross pieces 86 upon which the bottom of canister 76 rests.

As will be apparent to those skilled in the art, the size and/or configuration of adaptor 12, base 6, stand 10, and other elements used in inventive appliance 2 can be easily adapted and modified to accommodate the interchangeable use of any number of different gas fuels, canister heights, canister diameters, canister shapes, canister discharge fittings, and/or canister supply pressures.

An embodiment of adaptor 12 is depicted in FIGS. 13–16. This embodiment is particularly well suited for adapting a butane-burning device to the use of propane fuel. Inventive adaptor 12 comprises: a housing 104 including an inlet fitting/coupling 106 removably attached to an outlet fitting/coupling 108; a probe 110 projecting from inlet fitting 106; a valve assembly 112 provided in outlet fitting 108; a flow passage 114 extending through probe 110 and housing 104 to valve assembly 112; and an orifice element 116 positioned in flow passage 114 between probe 110 and valve assembly 112.

Inlet fitting 106 and probe 110 are of a type structured for attachment to, and activation of, most of the small, camping-type propane canisters available on the market. However, as will be apparent, generally any type of attachment structure and activation element can be used depending upon the structure of the fuel supply container to which inventive adaptor 12 is to be attached.

Inlet fitting 106 comprises: a large diameter, cylindrical rearward section 118 having a rearward end 120; a large diameter rearward bore 122 having internal threads 124 formed therein for releasable attachment to an externally-threaded propane canister discharge fitting; a threaded second bore 126 extending from the forward end of large bore 122; a threaded third bore 130 extending from the forward end of second bore 126; an externally threaded forward section 134 extending from rearward section 118 and having an external diameter smaller than that of section 118; a bore 136 extending into the forward end 138 of externally threaded section 134; a small, frusto-conical counter bore 137 extending from forward bore 136 to third bore 130; and a groove 140 formed in the forward end 138 of inlet fitting 106 for receiving an O-ring 142 or other sealing element.

Inlet fitting 106 further includes a raised lip or hub 144 provided around the rearward end of second bore 126. Thus, a flat radial groove 146 is formed at the forward end of large bore 122 for receiving a rubber gasket 148 or other sealing element. When the discharge fitting 18 of the propane canister is threadedly received in large bore 122, gasket 148 seals against the end of the propane discharge fitting.

Probe 110 comprises: an elongate segment 150 which projects from the rearward end 120 of inlet fitting 106; a threaded forward segment 152 which is threadedly received in second bore 126; an enlarged segment 154 between rearward segment 150 and forward segment 152 and having flats 156 provided thereon for tightening threaded segment 152 into second bore 126; a longitudinal flow channel 158 extending through probe 110; and a cap 160 provided on he distal end of rearward segment 150. A lateral slot 162 is provided across cap 160 in fluid communication with the rearward end of longitudinal flow channel 158. When the forward end 152 of probe 110 is received in interior threaded bore 126 of inlet fitting 106, a washer 164 is preferably positioned between the enlarged segment 154 of probe 110 and the end of the lip/hub 144 formed in large bore 122. Washer 64 preferably extends radially a sufficient distance to hold gasket 148 in groove 146.

The discharge fittings 18 of propane canisters 16 of the type used for camping will typically include a valve stem which is surrounded by an externally threaded coupling. Propane is released from the canister when the valve stem is depressed inwardly. Thus, probe 110 is constructed to interact with valve elements of this type such that, as the large threaded bore 122 of inlet fitting 106 is screwed on to the discharge fitting of propane canister 16, the cap 160 of probe 110 will contact the forward end of the propane valve stem and eventually depress the propane valve stem a sufficient distance to cause propane to be released from the canister. The propane flows through the lateral slot 162 of probe cap 160 and into longitudinal flow channel 158.

Orifice element 116 comprises: an externally threaded rearward section 166 which is received in the small, threaded, bore 130 of inlet fitting 106; a larger diameter forward section 168 having flats 170 provided on the exterior thereof for tightening orifice element 116 into threaded bore 130; a longitudinal flow channel 172 provided through orifice element 116; and an end wall, cap, plug or other element 174 provided at the forward end of, or elsewhere in, orifice element 116 and having a small, flow restriction orifice 178 formed therethrough. Orifice 178 is in fluid communication with the flow channel 172 and is sized to restrict the flow of propane from the propane canister and reduce its pressure sufficiently to enable it to be used in the butane-burning device 8 to which the other end of adaptor 12 is attached.

Figure 18:
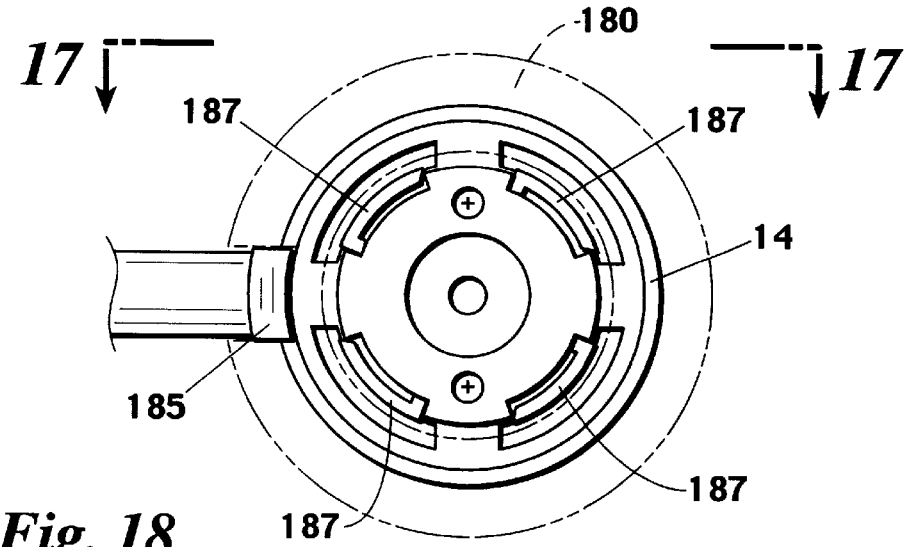
FIG. 18 is a bottom view of fitting 14 in an unsecured position.
Figure 19:
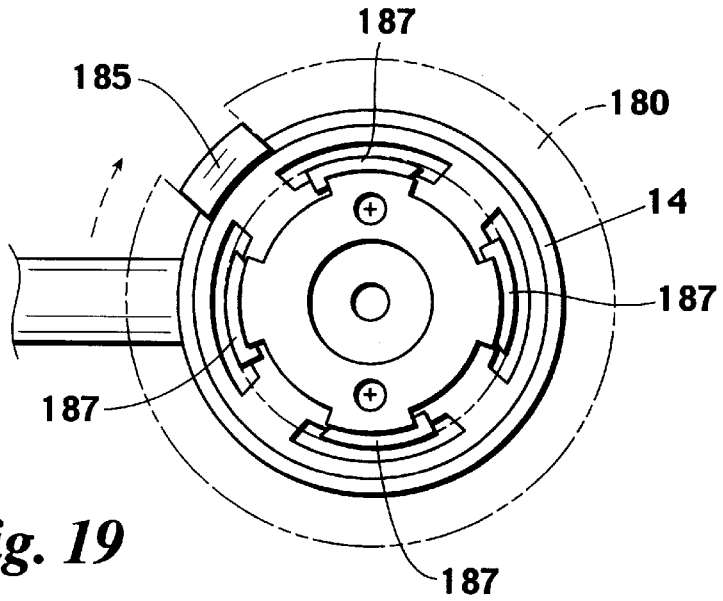
FIG. 19 is a bottom view of fitting 14 having adaptor 12 secured thereto.

The outlet fitting/coupling 108 and the valve assembly 112 of adaptor 12 are structured to attach to a gas inlet fitting 14 of a type commonly employed on butane-burning camp devices. Outlet fitting 108 includes a radial flange 180 on the forward end 182 thereof. A slot 184 is provided in radial flange 180 for receiving a post 185 which will typically be included in appliance fitting 14. Outlet fitting 108 can thus be secured to the appliance by positioning the post 185 of the appliance in slot 184 and rotating adaptor 12 slightly as depicted in FIGS. 18 and 19. As will be understood by those skilled in the art, the appliance fitting will typically include a plurality of fingers or grips 187 which are cammed outwardly against the interior wall 189 of adaptor outlet fitting 108 as adaptor 12 is turned.

Outlet fitting 108 further comprises: a rearward segment 186 having an internally threaded bore 188 for threadedly receiving the forward end 134 of inlet fitting 106; an interior radial wall 190 provided at the forward end of threaded bore 188; a forward bore 192 extending into the forward end 182 of outlet fitting 108; an annular groove 194 formed in forward bore 192 for receiving gripping fingers or other attachment structures associated with the appliance fitting; a hub 196 extending from interior radial wall 190 into forward bore 192; a passageway 198 extending through interior wall 190 and hub 196; and a radial lip 200 provided at the forward end of hub 196 and projecting into passage 198. Internal threads 202 are provided in at least the rearward portion of passage 198.

Valve assembly 112 comprises: a valve stem 204 which projects from the forward end of hub 186; a valve cage 206 which slidably receives and retains an enlarged rearward portion 221 of valve stem 204 and which includes an externally threaded forward portion 210 which is received in threaded hub 196; an O-ring or other sealing element 212 positioned in hub 196 between hub lip 200 and the forward end of valve cage 206; a cap 214 threadedly secured over the rearward end of valve cage 206; and a spring 216 contained within cage 206 between cap 214 and the enlarged rearward portion 221 of valve stem 204. Spring 216 continuously urges valve stem 204 outwardly. Cap 214 has a port 218 provided therethrough which allows gas to flow from orifice element 116 into valve cage 206.

Figure 16:
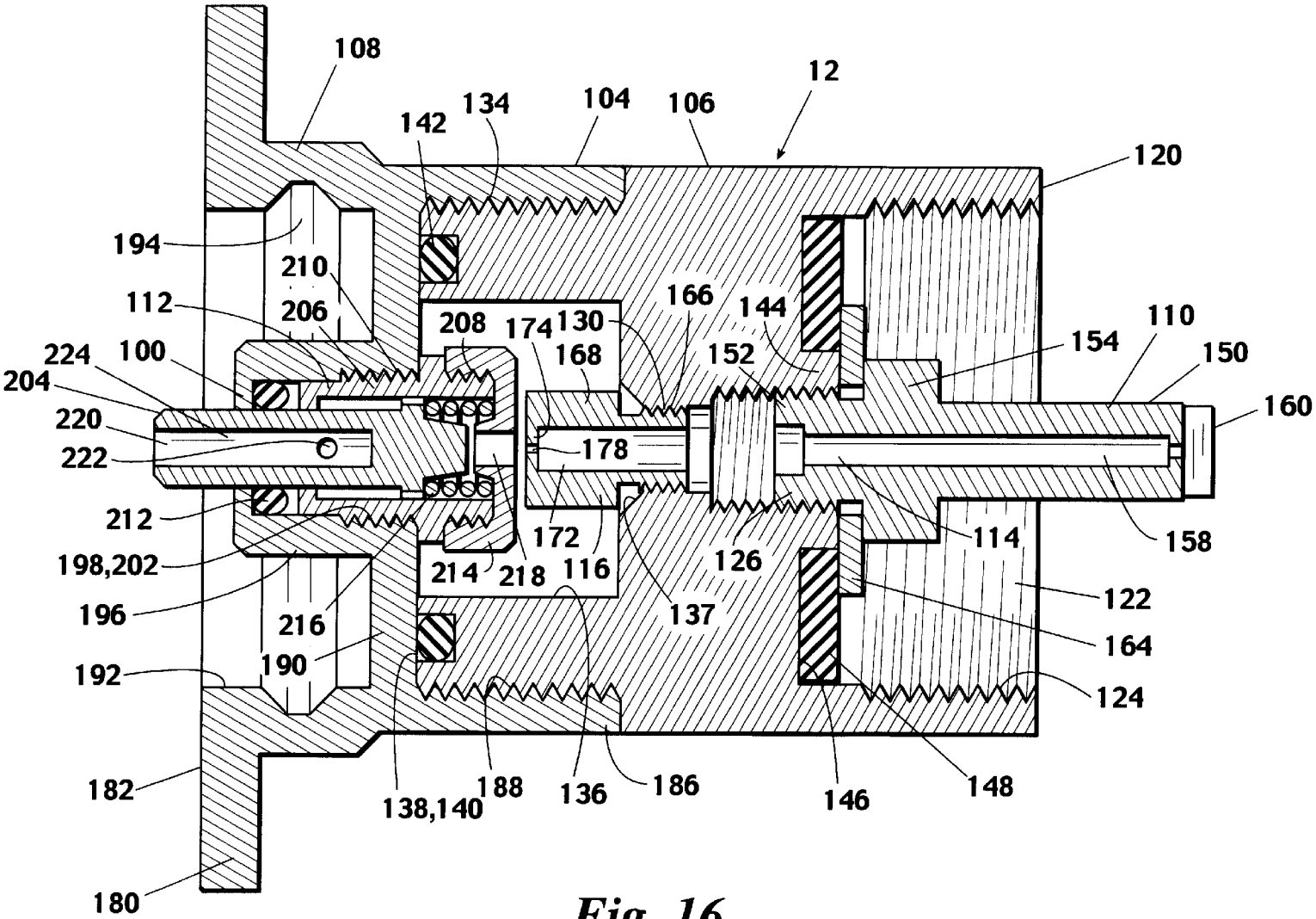
FIG. 16 is a cutaway elevational side view of adaptor 12 with valve assembly 112 in open position.
Figure 17:
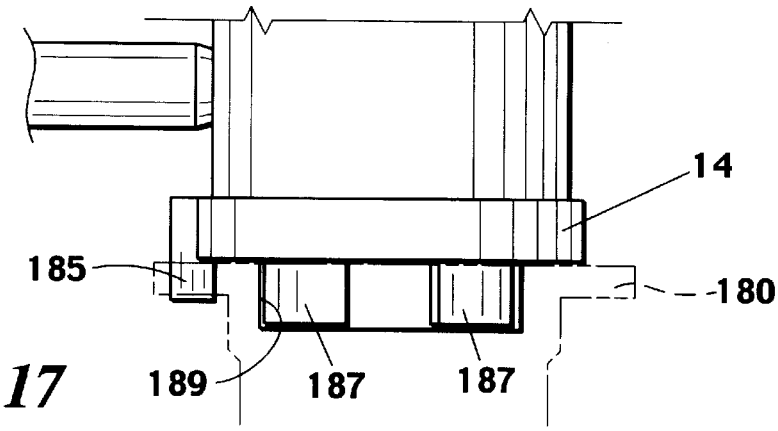
FIG. 17 is an elevational side view of a butane inlet fitting 14 employed in inventive appliance 2.

Valve stem 204 includes a flow passage 224 having an outlet port 220 provided at the forward end of valve stem 204 and an inlet port 222 provided through the side wall of the valve stem. Inlet port 222 is positioned such that, when inventive adaptor 12 is not attached to the gas burning device and valve stem 204 is thus held fully outward by spring 216, valve inlet port 222 will be positioned forwardly of O-ring 212. Thus, inlet port 222 will not be in fluid communication with the remainder of adaptor flow passage 114 so that valve assembly 112 will be closed. Valve assembly 112 is depicted in closed position in FIG. 15. As adaptor 12 is attached to the inlet fitting of the appliance, valve stem 204 is automatically pushed rearwardly to an open position wherein inlet port 222 is positioned within cage 206 behind O-ring 212. The open position of valve assembly 112 is depicted in FIG. 16.

Thus, when inventive adaptor 12 is fully assembled with inlet fitting 106 secured to the discharge coupling of propane canister 16 and outlet fitting 108 attached to the inlet fitting 14 of butane-burning assembly 8, the entire flow passage 114 of inventive adaptor 12 is open such that the propane fuel flows into and through the flow channel 158 of probe 110, the flow channel 172 and flow restriction orifice 178 of orifice element 116, the aperture 218 of cap 214, the interior of valve cage 206, and the inlet port 222 of valve stem 204.

As will be apparent, the inlet 106 and outlet 108 fittings of inventive adaptor 12 could be configured to mate with any type of gas discharge and appliance fittings. Additionally, as will be apparent to those skilled in the art, other types of restriction elements suitable for restricting the flow and reducing the pressure of the gas flowing through the inventive adaptor could be used. Examples of such elements include needle valves or other types of valve elements, adjustable or fixed regulators, tubing of a length and inside diameter sufficient to obtain a desired restriction in flow, multiple orifice elements, etc.

As mentioned above and as depicted in FIG. 3, inventive appliance 2 is preferably constructed such that burner assembly 8, stand 10, and adaptor 12 can be retained and secured within appliance housing 4 for storage. To store inventive appliance 2, base 6 is disconnected from the bottom of appliance housing 4 and any fuel canister 16 or 76 contained within appliance housing 4 is removed therefrom. Adaptor 12 is then placed on the interior bottom surface of base 6 such that the probe 110 of adaptor 12 is received within base cup 70. Next, the base 80 of stand 10 is nested on appliance base 6 over adaptor 12 is. Grooves 90 are provided in the cross pieces 86 of stand 10 for receiving the circular rearward end 120 of adaptor 12. Finally, with adaptor 12 and stand 10 placed thereon, base 6 is reattached to the bottom of appliance housing 4 and burner assembly 8 is pushed downwardly through the top of housing 4 to its storage position 56.

As depicted in FIG. 2, adaptor 12 can also be stored in housing 4 between base 6 and stand 10 when propane canister 76 is installed in inventive appliance 2.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. An apparatus adaptable for holding, and burning gas fuels from, different containers, said different containers including at least a first container and a second container and said apparatus comprising:

a housing sized such that each of said different containers is removably receivable in said housing, each of said different containers having an operating position in said housing, said operating position of said first container being different from said operating position of said second container;

burning means for burning gas fuel from said containers; and elevating means, positionable in said housing, for elevating and retaining said first container in said housing in its said operating position, wherein said elevating means being removable from said housing for placing said second container in said housing in its said operating position, and when none of said different containers are positioned in said housing, said elevating means can be placed in said housing and said burning means can be retracted into said housing for storing said elevating means and said burning means in said housing.

2. The apparatus of claim 1 further comprising a base removably attachable to a lower end of said housing, said elevating means being supported on said base when elevating and retaining said first container in its said operating position.

3. The apparatus of claim 1 further comprising a base removably attachable to a lower end of said housing, said second container resting directly upon said base when said second container is in its said operating position.

4. The apparatus of claim 1 further comprising an adaptor attachable between said second container and said burning means when said second container is in its said operating position.

5. The apparatus of claim 4 wherein said adaptor is removable such that said first container can be directly coupled with said burning means.

6. An apparatus adaptable for holding, and burning gas fuels from, different containers, said different containers including at least a first container and a second container and said apparatus comprising:

a housing sized such that each of said different containers is removably receivable in said housing, each of said different containers having an operating position in said housing, said operating position of said first container being different from said operating position of said second container;

burning means for burning gas fuel from said containers; and elevating means, positionable in said housing, for elevating and retaining said first container in said housing in its said operating position, said elevating means being removable from said housing for placing said second container in said housing in its said operating position;

an adaptor attachable between said second container and said burning means when said second container is in its said operating position, said second container includes a gas discharge fitting;

said burning means includes a gas inlet fitting configured to receive a fitting different from said gas discharge fitting of said second container; and said adaptor including an inlet coupling attachable to said gas discharge fitting of said second container and an outlet coupling attachable to said gas inlet fitting of said burner means.

7. The apparatus of claim 6 wherein said adaptor includes limiting means for limiting flow through said adaptor.

8. The apparatus of claim 6 wherein:

said burning means is constructed to receive and burn an intended gas fuel having an intended supply pressure and said second container has an internal pressure significantly greater than said intended supply pressure.

9. The apparatus of claim 6 wherein:

said second container is a propane container having a propane discharge fitting;

said burning means is a butane burning means having a butane inlet fitting;

said adaptor includes an inlet coupling attachable to said propane discharge fitting; and said adaptor further includes an outlet coupling attachable to said butane inlet fitting.

10. An apparatus adaptable for holding, and burning gas fuels from, different containers, said different containers including at least a first container and a second container and said apparatus comprising:

a housing sized such that each of said different containers is removably receivable in said housing, each of said different containers having an operating position in said housing, said operating position of said first container being different from said operating position of said second container;

burning means for burning gas fuel from said containers;

elevating means, positionable in said housing, for elevating and retaining said first container in said housing in its said operating position, said elevating means being removable from said housing for placing said second container in said housing in its said operating position; and an adaptor attachable between said second container and said burning means when said second container is in its said operating position, wherein said adaptor includes limiting means for limiting flow through said adaptor, said burning means is constructed to receive and burn an intended gas fuel having an intended supply pressure, and said second container has an internal pressure significantly greater than said intended supply pressure.

11. The apparatus of claim 10 wherein said internal pressure of said second container is at least 2.5 times said intended supply pressure.

12. The apparatus of claim 10 wherein said first container has an internal pressure substantially equivalent to said intended supply pressure.

13. An apparatus adaptable for holding, and burning gas fuels from, different containers, said different containers including at least a first container and a second container and said apparatus comprising:

a housing sized such that each of said different containers is removably receivable in said housing, each of said different containers having an operating position in said housing, said operating position of said first container being different from said operating position of said second container;

burning means for burning gas fuel from said containers;

elevating means, positionable in said housing, for elevating and retaining said first container in said housing in its said operating position, said elevating means being removable from said housing for placing said second container in said housing in its said operating position; and an adaptor attachable between said second container and said burning means when said second container is in its said operating position, wherein said second container is a propane container having a propane discharge fitting, said burning means is a butane burning means having a butane inlet fitting, said adaptor includes an inlet coupling attachable to said propane discharge fitting, and said adaptor further includes an outlet coupling attachable to said butane inlet fitting.

14. The apparatus of claim 13 wherein:

said first container is a butane container having a butane discharge fitting and when said first container is in its said operating position in said housing, said butane discharge fitting is directly attachable to said butane inlet fitting of said burning means.

15. An apparatus adaptable for holding, and burning gas fuels from, different containers, said different containers including at least a first container and a second container and said apparatus comprising:

a housing sized such that each of said different containers is removably receivable in said housing, each of said different containers having an operating position in said housing, said operating position of said first container being different from said operating position of said second container;

burning means for burning gas fuel from said containers;

elevating means, positionable in said housing, for elevating and retaining said first container in said housing in its said operating position, said elevating means being removable from said housing for placing said second container in said housing in its said operating position; and an adaptor attachable between said second container and said burning means when said second container is in its said operating position, wherein, when none of said different containers are positioned in said housing, said elevating means and said adaptor can be placed in said housing and said burning means can be retracted into said housing for storing said elevating means, said adaptor and said burning means in said housing.

* * * * *